United States Patent [19]

Narozny

[11] 4,270,826

[45] Jun. 2, 1981

[54] ZERO INSERTION FORCE CONNECTOR

[75] Inventor: Ronald S. Narozny, Panorama City, Calif.

[73] Assignee: Thomas & Betts Corporation, Raritan, N.J.

[21] Appl. No.: 8,544

[22] Filed: Feb. 1, 1979

[51] Int. Cl.[3] ..... H01R 13/62

[52] U.S. Cl. ..... 339/75 MP; 339/176 MP

[58] Field of Search ..... 200/51, 12, 16; 339/17 F, 75 M, 75 MP, 91 R, 176 MP, 176 MF, 74 R

[56] References Cited

U.S. PATENT DOCUMENTS

| | | | |
|---|---|---|---|
| 3,611,259 | 10/1971 | Palecek | 339/176 MP X |
| 3,905,670 | 9/1975 | Awhalt et al. | 339/75 MP |
| 3,989,336 | 11/1976 | Rizzio et al. | 339/17 F X |
| 4,069,403 | 1/1978 | Beaudette et al. | 200/51.12 |
| 4,076,362 | 2/1978 | Ichimura | 339/75 MP |

*Primary Examiner*—Eugene F. Desmond

*Attorney, Agent, or Firm*—James J. Daley; Robert M. Rodrick; Jesse Woldman

[57] ABSTRACT

A zero insertion force type connector for receiving a printed circuit board or the like for making selective electrical contact with the electrical circuitry thereon. The connector comprises a housing having one side thereof with an opening for insertion of a printed circuit board into the housing and a plurality of individual conductors supported within the housing. Each of the individual conductors is movable between a contact position in which the conductor is adapted to engage an associated contact portion on the printed circuit board and a non-contact position in which the conductor is spaced from the printed circuit board when the printed circuit board is in the housing. The individual conductors are normally biased toward and non-contact position so that the printed circuit board may be inserted into the housing with minimal force. A corresponding individual selectively operable actuator member is provided for each of the individual conductors. Each of the actuator members is independently movable between a first position in which the actuator member urges its corresponding conductor into the contact position and a second position in which the corresponding conductor is free to assume its non-contact position.

18 Claims, 5 Drawing Figures

ZERO INSERTION FORCE CONNECTOR

BACKGROUND OF THE INVENTION

The present invention relates to electrical connectors for printed circuit boards and more particularly, to what is commonly known as low or zero insertion force type connectors for making electrical contact with the electrical circuitry on printed circuit boards and the like.

It is desirable that printed circuit board connectors have high engagement and removal forces. This in turn results in high mating forces of the contacts with the conductive pads on the board. In some instances, this is by design such as when high pressure contacts are used to overcome bad surfaces (unwanted film or oxides) on the contact pads of the board, or in order to standarize connectors to accommodate large variations in printed circuit board thickness. A drawback inherent with high pressure contacts, however, is the difficulty in inserting and removing the board. To alleviate the problems of high mating forces which interfere with insertion and removal of the printed circuit boards, various types of zero force connectors have been designed.

Typical low or zero force type connectors for printed circuit boards comprise a housing assembly with a slot or opening therein to receive an edge portion of the printed circuit board and provided with contacts in the slot biased resiliently to cooperate with complimentary electrical terminal pads on the printed circuit board. These connectors generally fall into one of two types: (i) those in which the contacts are forced against the board after insertion of the board, and (ii) those in which the contacts are forced away from the board for insertion of the board, then allowed to spring back into contact with the pads on the board. In either type, the contacts are maintained out of the way temporarily to avoid interference with insertion of the printed circuit board, and to avoid damage and/or frictional wear on the contacts of the printed circuit board.

Various types of actuating devices have been designed for moving the contacts into and out of an engaging position with the printed circuit board to allow for easy insertion and/or removal of the printed circuit board from the connector. See for example U.S. Pat. Nos. 3,883,207; 3,638,167; 3,744,005; 3,636,499; 3,553,630; and 3,568,134.

However, low or zero insertion force type connectors to date have all provided a single actuating member for moving a plurality of contacts into or out of engagement, generally a single actuator member being provided for each side of the printed circuit board or substrate inserted into the connector. For example, in U.S. Pat. No. 3,475,717 entitled "Zero Force Connector," two series of contact members are provided on opposite sides of the slot into which the printed circuit board is received and are normally biased away from engagement to permit easy insertion of the printed circuit board without physical engagement with the contact members. After the circuit board is inserted into the slot of the connector, a pair of actuator plates, one for each series of contact members, are moved into impinging engagement with its series of resilient contact members to displace the contact members into engagement with the electrical circuitry on the circuit board.

In some instances, a single actuator member has been provided for actuating the contact members on both sides of the circuit board. For example, in U.S. Pat. No. 3,665,370, entitled "Zero Insertion Force Connector," a single actuator member serves to cam the series of contacts on either side of the printed circuit board into an engaging contact position upon rotation of the actuator member.

While some of these prior art arrangements have resulted in a simplification for making electrical contact with the electrical circuitry on the printed circuit board, the prior art type connectors to date have not been capable of providing selective engagement of the contact members with the electrical circuitry on the printed circuit board. Rather, with the prior art devices, all of the contact members (at least on one side of the printed circuit board) must either be in the engaged, contact position, or in the non-engaged, non-contact position. This is disadvantageous in that such prior art arrangements do not allow for testing of any individual circuits on the printed circuit board, such as for example to determine malfunctioning or defective components in the electrical circuitry, while the printed circuit board is in the connector. Furthermore, prior art devices do not have the capability of providing different combinations of opened and closed contact members to provide a programmable printed circuit board connector.

SUMMARY OF THE INVENTION

These and other disadvantages of the prior art are overcome with the present invention which provides a zero insertion force type connector for receiving a printed circuit board or the like and for making selective electrical contact with the electrical circuity thereon. In accordance with the present invention the zero insertion force type connector comprises a housing having one side thereof with an opening for insertion of the printed circuit board into the housing, and a plurality of individual conductors supported within the housing. Each of the individual conductors is movable between a contact position in which the conductor is adapted to engage an associated contact portion on the printed circuit board when the printed circuit board is inserted into the housing, and a non-contact position in which the conductor is spaced from the printed circuit board when the printed circuit board is in the housing. The individual conductors are normally biased toward the non-contact position so that the printed circuit board may be inserted into the housing with minimal force. Corresponding individual selectively operable actuator members are provided for each of the individual conductors. Each of the actuator members is independently movable between a first position in which the actuator member urges its corresponding conductor into its contact position and a second position in which its corresponding conductor is free to assume its non-contact position. With such a device, the connector is selectively programmable to provide any combination of conductors in engagement with the electrical circuitry on the printed circuit board. This is advantageous for testing of individual circuits on the circuit board without having to remove the printed circuit board from the conductor. Further, such connectors are suitable for mass production and standardization in that they may be used for providing electrical contact with selective and/or different contact terminals on a variety of different types of circuit boards.

In the preferred embodiment, the connector is provided with means for selectively maintaining the actuator members in the first position. In a further preferred embodiment, this means for selectively maintaining the actuating members in the first position comprises a shoulder or groove in the housing for engaging a tongue portion of the actuator members to hold the actuator members in engagement with its corresponding individual conductor when the actuating members are moved into the first position.

In a still further preferred embodiment, the actuator members each comprise a resilient flexible finger having a first end fixably supported with respect to the housing and having the other end movable between the first and second positions and normally biased into the second position. In a still further preferred embodiment, the resilient flexible fingers include a portion extending externally of the housing by which the flexible finger may be moved from the second position to the first position. Further still, the connector preferably includes access openings extending from outside the housing to a position adjacent the groove for holding the flexible resilient fingers in the first position so that individual access is provided to selectively move the resilient fingers out of engagement with the groove to release the fingers to assume their second position.

These and further features and characteristics of the present invention will be apparent from the following detailed description in which reference is made to the enclosed drawings which illustrate the preferred embodiment of the present invention.

DETAILED DESCRIPTION OF THE PREFERRED EMBODIMENT

Figure 1:
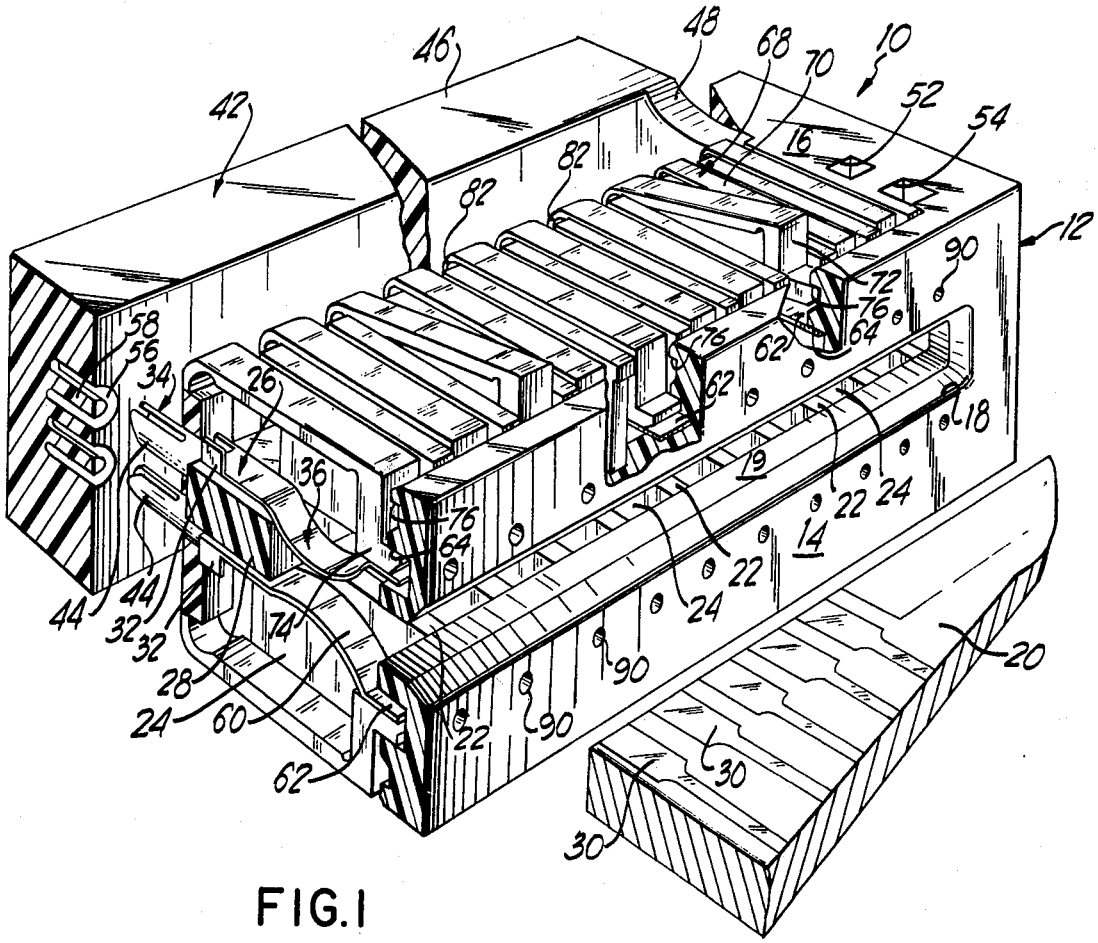
FIG. 1 shows a partially exploded view, partially broken away, of the zero insertion force type connector in accordance with the present invention with a printed circuit board shown removed from the connector for clarity but with some of the connector's conductor members in their engaging position.

Referring now to the drawings in which like reference characters represent like elements there is shown in FIG. 1 the zero insertion force type connector 10 of the present invention. The connector 10 comprises generally a rectangular box-like housing 12, preferably fabricated from a suitable insulating material, such as for example, a thermoplastic material, having a front wall section 14 and a pair of side wall sections 16 (only one of which is shown) integrally joined thereto and extending along the side edges of the connector housing 12. The front wall section 14 is provided with an elongated aperture or opening 18 extending into a circuit board receiving cavity 19 in the housing 12 for insertion of a printed circuit board 20. A plurality of spaced ribs 22 extend rearwardly from the front wall section 14 to define a plurality of conductor member chambers or recesses 24 arranged along the longitudinal length of a connector housing 12 on opposite sides of the circuit board receiving cavity 19. These conductor member chambers 24 are adapted for receiving and supporting within the housing 12 a plurality of individual conductor members 26, as more fully described hereinbelow. Each of the conductor member chambers 24 is open to the printed circuit board receiving cavity 19 but is separated from its adjacent chamber by one of the ribs 22 extending from the front wall section 14. A rear end wall section 28 of the housing 12 is integrally joined to the spaced ribs 22 and to the side wall sections 16 and serves to terminate the printed circuit board receiving chamber 19.

The printed circuit board 20 may comprise any suitable or conventional circuit board fabricated from a suitable dielectric base and having a plurality of circuits in the form of conductive coatings printed thereon in any desired pattern. The circuits terminates in contact terminals or pads 30 at the board edge which is to be inserted into the cavity 19 of the connector housing 12. Each of the pads 30 is in alignment with one of the conductor member cavities 24 defined between the ribs 22 when the printed circuit board 20 is inserted into the cavity 19 of the housing 12. That is, a contact pad 30 need not be provided for each conductor member cavity 24, but each contact pad 30 which is provided must lie in alignment with one of the conductor member cavities 24. Further, it is to be noted that since the conductor member cavities 24 are arranged on opposite sides of the elongated recessed opening 19, contact pads 30 may be provided on the opposite sides of the printed circuit board 20 (i.e., the top and bottom sides of the printed circuit board as viewed in FIG. 1).

Figure 3:
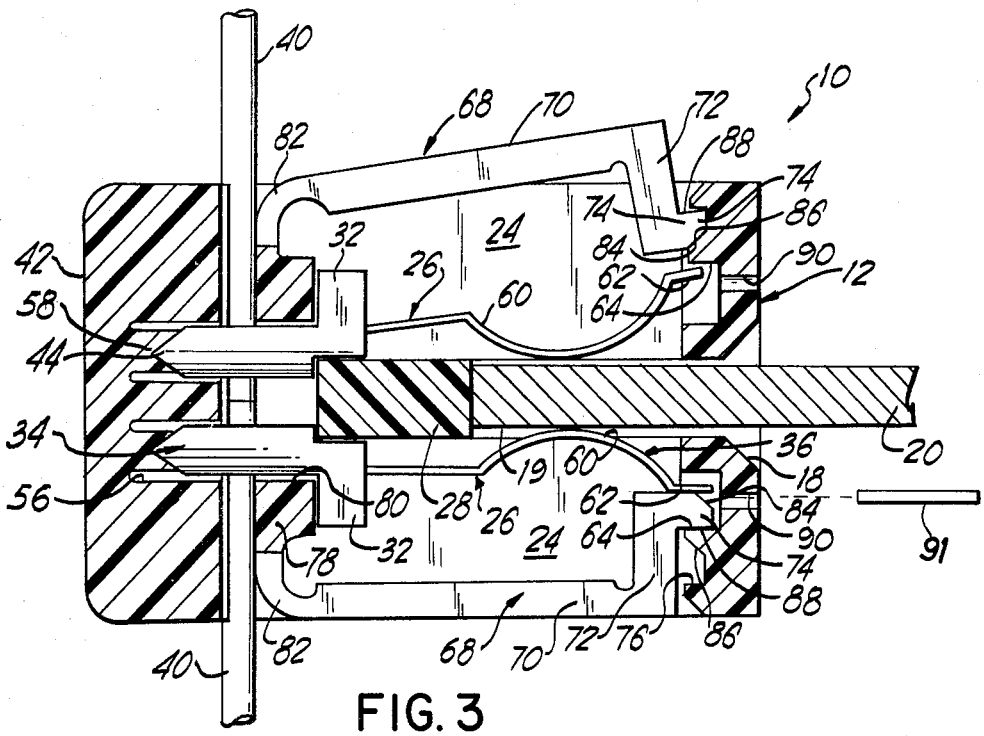
FIG. 3 is a cross-sectional view taken along lines 3—3 of FIG. 2 showing an opposing pair of conductors, one in an engaging, contact position and the other in a non-engaging, non-contact position.
Figure 5:
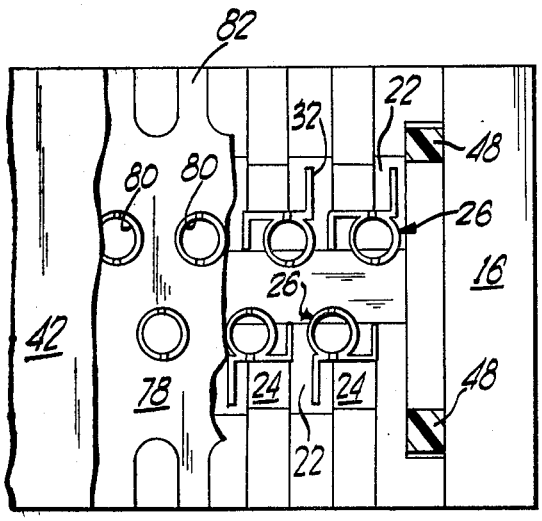
FIG. 5 is a rear plan view of the connector, partially broken away, in accordance with the present invention, to illustrate the terminal ends of the conductors.

A plurality of individual, and preferably identical, conductor members 26 are supported in the housing 12 in the conductor member cavities 24 on each side of the elongated cavity 19 behind the front wall section 14. As viewed in FIG. 3, one series of conductor members 26 are supported in the cavities above the access cavity 19 and a second series in the cavities 24 below the access cavity 19. The conductor members 26 each include an intermediate arm portion 32 to support the conductor members 26 on the rear end wall 28 and the housing ribs 22. The conductor members 26 also each include a terminal end 34 and a contact end 36, the contact end 36 being adapted to move between a relaxed or non-engaging position and an engaging or contact position in which the contact end 36 extends into the opening 19 for receiving the printed circuit board 20 for making electrical contact with the circuitry thereon.

Figure 2:
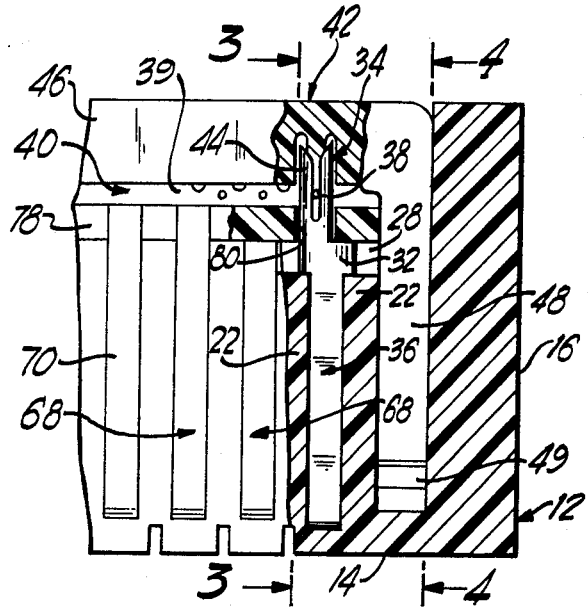
FIG. 2 is a top plan view, partially broken away, of the connector in accordance with the present invention.

Any suitable terminal end 34 for making an appropriate electrical connection with external circuitry or components may be used. In the preferred embodiment, the terminal ends 34 comprise cable insulation piercing terminal ends which are adapted to pierce and receive the individual wires 38 of a ribbon cable 40 inserted between a rear housing end cover 42 and the housing 12 for making appropriate electrical connections with the conductor members 26. Such a ribbon cable 40, as is conventional, has a plurality of parallel wires 38 arranged in side by side relationship and surrounded with insulation 39. The cable piercing terminal ends 34 include a pair of spaced insulation piercing tips 44 defining a recessed slot for receiving and making electrical contact with a wire 38 of the ribbon cable 40 when the ribbon cable 40 is inserted through the opening defined between the housing end cover 42 and the housing 12 and the cover 42 is clamped down onto the housing 12. This can be seen for example in FIG. 2.

Figure 4:
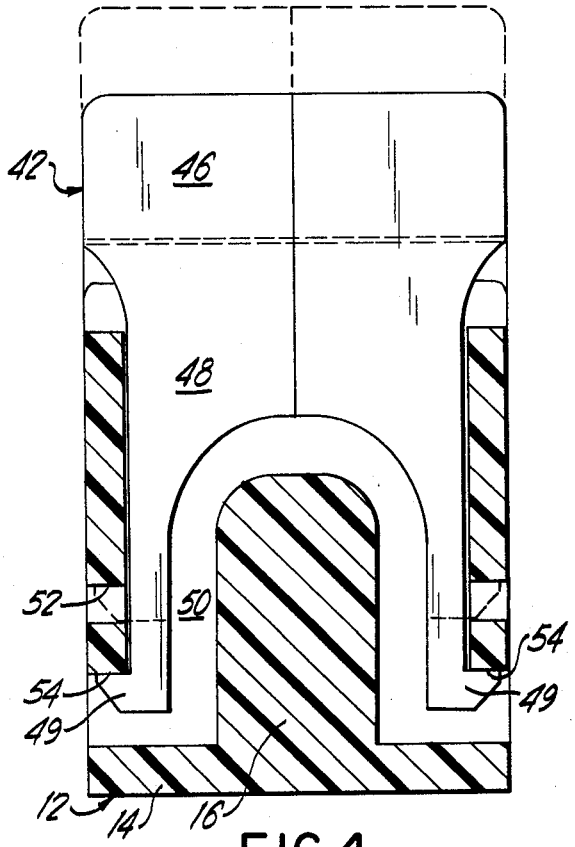
FIG. 4 is a cross-sectional view taken along lines 4—4 of FIG. 2 illustrating how the cover of the connector is attached to the connector housing.

The housing end cover 42, as with the housing, is made of a suitable insulating material, such as for example thermoplastic material. The housing end cover 42 is formed in a general U-shaped configuration having an elongated end wall 46 and a pair of side walls 48 which are adapted to be received in appropriate recesses 50 in the housing 12 adjacent the housing side wall section 16 (See FIG. 4). The end cover side walls 48 are each provided with oppositely arranged tongue members 49 which are adapted to be received in appropriate openings 52, 54 in the front wall section 14 of the housing 12 to retain the end cover 42 in the housing 12 (see FIG. 4).

In the preferred embodiment, two sets of end cover grooves 52, 54 are provided in the housing 12. The first set of grooves 52 are spaced farther from the front wall section 14 than the second set of grooves 54 and serve to hold the end cover housing 42 in a first position to provide a relatively wide slotted opening between the housing 12 and the end cover 42 so that ribbon cable 40 may be easily inserted into the opening. To make electrical contact with the ribbon cable 40, an appropriate tool may be used to clamp or crimp the end cover 42 into the housing 12 to move the two components together. This clamping or crimping serves to force the ribbon cable 40 into the terminal ends 34 of the connector members 26 so that electrical connection is made between the wires 38 in the cable 40 and the terminal end portions 34 of the conductor members 26. For this purpose, the inner face of the end cover may be provided with appropriate openings 56 and a central depressing member 58 which serves to ensure that the cable 40 is depressed into the slot in the terminal end connectors 34. The second set of grooves 54 serve to retain the end cover 42 in the second closed contact position.

The contact ends 36 of the conductor members 26 comprise a spring finger having a curved contact portion 60 and a projecting tip 62. The contact fingers 36 are normally biased away from the circuit board access opening 19 when they are supported in the conductor member chambers 24 on the intermediate ribs 32. In the preferred embodiment, a groove 64 is provided on the inner surface of the front wall section 14 which serves as a stop against which the projecting tips 62 are normally biased (see FIG. 3). In this position, the curved contact portion 60 lies outside the circuit board receiving cavity 19 so that it will not be in engagement or contact with the printed circuit board 20 when the printed circuit board is inserted into the cavity 19. The connector 10 further includes a plurality of individual, selectively operable actuator members 68, one actuator member 68 for each conductor member 26. These actuator members 68 are made of a suitable insulating material, preferably of a thermoplastic material. Each of the actuating members 68 includes an elongated arm 70 and a enlarged conductor engaging portion 72 sized to engage the projecting tip 62 of its associated conductor member 26 to move same from the non-contact position into the contact position. The enlarged conductor engaging portion 72 also includes a tongue or tip 74 at its end which is adapted to be received in appropriate grooves 64, 76 formed on the inner face of the forward wall section 14. The innermost grooves 64 (i.e., the grooves formed adjacent the printed circuit board receiving cavity 19 and in which the projecting tips 62 of the conductor members 26 protrude) serve to hold the actuating members 68 in a first position to cause the associated conductor members 26 to be urged into the engaging position to engage the contact pads 30 on the printed circuit board 20. The outermost grooves 76 (i.e., those located furthest from the printed circuit board receiving cavity 19) serve to retain the actuating members 68 in a second position in which the conductor members 26 are free to assume their non-contact positions.

The elongated arm portion 70 of the actuator members 68 are joined to a common supporting plate 78 made of similar suitable plastic material and affixed to the housing. The common supporting plate 78 includes appropriate apertures 80 through which extend the terminal ends 34 of the conductor members 26. Thus, the intermediate ribs or arms 32 of the conductor members 26 are confined between the common supporting plate 78 on one side and the ribs 22 and rear end wall 28 on the other side to support the conductor members 26 in the conductor member chambers 24 in the housing 12.

In the preferred embodiment, the common supporting plate 78 serves to support all of the actuating members 68 in each of the two series on opposite sides of the printed circuit board receiving cavity 19. The elongated arms 70 of the actuator members 68 are appropriately joined to the common supporting plate 78 through a thin rib 82 so as to be easily movable between the first and second positions. Thus, the thin rib portions 82 serve to allow the actuator members 68 to move toward and away from the printed circuit board receiving recess 19 as well as away from the front wall section 14 to release the tongue portions 74 thereof from engagement with the grooves 64, 76 in the housing 12.

In this regard, the tongue portions 74 of the actuator members 68 include a sloped camming surface 84 which mates with a corresponding sloped camming surface 86 on the groove 76 so that the fingers 68 may be moved from the second non-engaging position to the first engaging position simply by depressing or pushing the fingers 68 towards the cavity 19 to cam the fingers 68 out of engagement with the outermost grooves 76 and into engagement with the innermost groove 64. On the other hand, the tongue portions 74 also include a shoulder 88 which serves to lock the fingers 68 in the grooves 64, 76 against movement in a direction generally away from the recessed opening 19. Appropriate openings 90 are provided in the front wall section 14 which communicate with the innermost grooves 64 to provide access to the tongue portions 74 of the actuating fingers 68 when same are in their first engaging position so that the tongue portions 74 may be moved out of engagement with the grooves 64, and the actuating fingers 68 moved to the second non-engaging position. In this regard, the actuating fingers 68 preferably are somewhat resilient and are biased to normally assume their second position so that when the tongue portions 74 are moved out of engagement with the innermost grooves 64, the actuator members 68 will spring back to their second non-engaging position and the tongue portions 74 will engage the outermost grooves 76.

It is to be noted that when the actuator members or fingers 68 are in their second position (i.e., not in engagement with the conductor members 26) the fingers 68 extend or protrude beyond the outline of the housing 12, whereas they lie within the outline of the housing 12 when in their first engaging position. This provides a convenient means for determining which conductor members 26 are in the contact position and which conductor members 26 are in the non-contact position.

With the present invention, it is possible to program the connector 10 in any desired manner so that only a selective number of the conductor members 26 in selective locations serve to provide electrical connection to the electrical circuitry on the printed circuit board 30. Thus, it can be seen in FIG. 1 that the third and eighth actuator members 68 from the side wall section 16 of the upper or first series are in their second non-engaging position so that their respective conductor members 26 assume the non-contact position, whereas the remaining actuator members 68 are in their first position urging their respective conductor members 26 into engagement with the contact terminals 30 on a printed circuit board 20 in alignment therewith.

This programmable feature is advantageous for providing testing of individual circuits on the printed circuit board and/or for standardization of the connector 10 to accommodate different sized and different dimensioned printed circuit boards 20 having the contact pads 30 thereof arranged in different patterns. For example, if a single circuit on the printed circuit board 20 is to be tested, electrical connection can be severed with respect to the remaining contact pads by simply moving the respective actuator members 68 to the second, release position so that their respective conductors 26 disengage. Also, different combinations of circuits can be easily tested in a similar manner by simply selectively engaging only those conductor members 26 which serve to make electrical connection with the contact terminal pads to be tested if different patterns of contact terminals are arranged on the circuit board 20.

It is seen that the circuit board 20 need not be removed from the connector 10 for testing purposes but may be retained therein. Here, it should be noted that when the conductor members 26 are in their contact position, a relatively high mating force is applied to hold the printed circuit boards 20 in engagement in place in the connector 10. Thus, if desired, the conductor members 26 not in alignment with contact terminals 30 on the circuit board 20, can be moved into the engaging position to hold the circuit board 20 in place in the connector housing 12. Of course, other suitable means for holding the circuit board 20 in the connector 10 could be provided.

Further, it is to be noted that selective programmable connection with the printed circuit board 20 is easily accomplished in view of the fact that the individual actuator members 68 are simply moved between the first and second positions with a minimum of effort, not requiring any elaborate equipment or numerous steps for moving the actuator members 68 from one position to another. To go from the second, release position to the first engaging position, the members 68 may be simply pressed or pushed inwardly. To go from the engaging first position to the second release position, a suitable probe 91 need only be inserted in the opening 90 to move the tongue member 74 out of engagement with the innermost groove 14 and the actuator finger 68 will spring to its second, release position.

While the preferred embodiment of the present invention has been shown and described, it will be understood that such is merely illustrative and that changes may be made without departing from the scope of the invention as claimed.

What is claimed is:

1. A zero insertion force type connector for receiving a printed circuit board or the like and making selective electrical contact with the electrical circuitry thereon, said connector comprising:

a housing having one side thereof with an opening for insertion of the printed circuit board therein;

a plurality of individual conductors supported within said housing, each of said individual conductors being movable between a contact position in which said conductor is adapted to engage an associated contact portion on said printed circuit board, and a noncontact position in which said conductor is spaced from said printed circuit board when said printed circuit board is in the housing, said individual conductors being biased toward said noncontact position so that the printed circuit board may be inserted into said housing with a minimal force;

a corresponding individual selectively operable actuator member for each of said individual conductors, each of said actuator members being independently movable in any desired sequence between a first position in which said actuator member is restrained from movement and urges its corresponding conductor into its said contact position and a second position in which its corresponding conductor is free to assume its said noncontact position, each said actuator member being biased toward said second position; and release means for each said actuator member in said first position permitting release of such movement restraint and enabling biased movement individually of each said actuator member to said second position thereof.

2. The zero insertion force type connector of claim 1 including means for selectively maintaining said actuator members in said first position comprising a groove provided in said housing for engaging a tongue portion of said actuator members to hold said actuator members in said first position when said actuator members are moved into said first position.

3. The zero insertion force type connector of claim 2 wherein each of said actuator members comprises a resilient flexible finger, one end of said flexible resilient finger being fixably supported with respect to said housing and the other end of said flexible resilient finger being movable relative to said housing to move between said first position and said second position.

4. The zero insertion force type connector of claim 3 wherein said groove in said housing comprises a first groove and wherein said housing includes a second groove for engaging said tongue portions of said flexible fingers to hold said fingers in said second position.

5. The zero insertion force type connector of claim 1 wherein said release means comprises an access opening extending from the exterior of said housing to a position adjacent said actuator member first position.

6. The zero insertion force type connector of claim 1 wherein each of said actuator members comprises a resilient flexible finger, one end of said flexible resilient finger being fixably supported with respect to said housing and the other end of said flexible resilient finger being movable relative to said housing to move between said first position and said second position.

7. The zero insertion force type connector of claim 6 wherein said resilient flexible fingers are self-biased towards said second position.

8. The zero insertion force type connector of claim 7 wherein said resilient flexible fingers are accessible from outside said housing to move said fingers from said second position into said first position.

9. The zero insertion force type connector of claim 1 wherein each of said individual conductors comprises a terminal end portion accessible from outside said housing for providing electrical connection thereto and a resilient contact end portion supported in said housing, said resilient contact end portion being free to move between said contact position and said non-contact position and being biased towards said non-contact position.

10. The zero insertion force type connector of claim 9 wherein said opening in said housing comprises an elongated cavity and wherein said individual conductors are disposed on the opposite elongated sides of said cavity, said resilient contact end portions when in said contact position extending into said cavity and when in said non-contact position being spaced from said cavity.

11. The zero insertion force type connector of claim 10 wherein said actuator members associated with said individual conductors are disposed on opposite elongated sides of said cavity with said contact end portions of the associated individual conductors being positioned between said cavity and said actuator members.

12. The zero insertion force type connector of claim 11 wherein said housing further includes a pair of grooves on opposite elongated sides of said cavity for engaging a tongue portion of said actuator members on the opposite elongated sides of said cavity to hold said actuator members in said first position when said actuator members are moved into said first position.

13. The zero insertion force type connector of claim 12 wherein each of said actuator members comprises a resilient flexible finger, one end of said flexible resilient finger being fixably supported with respect to said housing and the other end of said flexible resilient finger being movable relative to said housing to move between said first position and said second position.

14. The zero insertion force type connector of claim 13 wherein the fixed ends of said resilient fingers on opposite elongated sides of said cavity are integrally joined to a common supporting plate attached to said housing.

15. The zero insertion force type connector of claim 14 wherein said common supporting plate is affixed to a second side of said housing opposite from said side having said cavity and wherein said terminal end portions of said individual conductors extend externally of said housing through said common supporting plate.

16. The zero insertion force type connector of claim 15 wherein said individual conductors each include intermediate arm supporting means intermediate said terminal end portion and said contact end portion, said arm supporting means being positioned between said second side of said housing and said common supporting plate to support said contact end portions in said housing.

17. A connector for receiving a printed circuit board or the like and making selective electrical contact with the electrical circuitry thereon, said connector comprising:

a housing having a cavity extending interiorly from one side thereof for receipt of such printed circuit board therein;

a plurality of individual conductors supported within said housing, each of said individual conductors being movable between a contact position in which said conductor extends into said cavity and a non-contact position in which said conductor is spaced from said cavity;

a corresponding individual selectively operable actuator member for each of said individual conductors, each of said actuator members being movable independently of other actuator members between a first position in which said actuator member urges its corresponding conductor into its said contact position and a second position enabling its corresponding conductor to assume said noncontact position said actuator members being operable in any desired sequence; and release means independent of said actuator members providing for selective individual engagement with each said actuator member for movement thereof from said first position to said second position thereof.

18. The connector claimed in claim 17 wherein said release means is defined in part by said housing, said housing having openings extending into registry with each said actuator member when disposed in said first position thereof, each said opening supporting movement of a probe therethrough into engagement with said actuator member in registry therewith.

* * * * *